US007192183B2

(12) United States Patent
Chan

(10) Patent No.: US 7,192,183 B2
(45) Date of Patent: Mar. 20, 2007

(54) DEVICE WITH HOUSING AND DAMPED, MOTION TO EXTENDED POSITION

(75) Inventor: Sik Leung Chan, Tsuen Wan (HK)

(73) Assignee: C.C.&L Company Limited, Tsuen (HK)

( * ) Notice: Subject to any disclaimer, the term of this patent is extended or adjusted under 35 U.S.C. 154(b) by 68 days.

(21) Appl. No.: 11/208,973

(22) Filed: Aug. 22, 2005

(65) Prior Publication Data

US 2006/0227668 A1 Oct. 12, 2006

Related U.S. Application Data

(63) Continuation-in-part of application No. 29/227,397, filed on Apr. 11, 2005.

(51) Int. Cl.
*G04B 37/00* (2006.01)

(52) U.S. Cl. ..... 368/316; 368/276

(58) Field of Classification Search ..... 368/10, 368/316, 317, 276, 277
See application file for complete search history.

(56) References Cited

U.S. PATENT DOCUMENTS

| | | | | |
|---|---|---|---|---|
| 889,436 | A | 6/1908 | Bustanoby | |
| 2,013,575 | A * | 9/1935 | Moffatt | 368/277 |
| 2,125,294 | A * | 8/1938 | Lathrop | 368/317 |
| 3,444,685 | A | 5/1969 | Juillerat | |
| 3,618,518 | A | 11/1971 | Rigoni | |
| 4,081,217 | A | 3/1978 | Klaber | |
| 4,149,812 | A | 4/1979 | Huffman, Jr. | |
| 4,549,827 | A | 10/1985 | Mack | |
| 4,804,286 | A | 2/1989 | Jarrett et al. | |
| 5,061,104 | A | 10/1991 | Florjancic | |
| 5,531,318 | A | 7/1996 | Coleman et al. | |
| 5,568,452 | A | 10/1996 | Kronenberg | |
| 6,120,816 | A | 9/2000 | Chan | |
| D436,868 | S | 1/2001 | Chan | |
| 6,178,085 | B1 | 1/2001 | Chan | |
| 6,273,627 | B1 | 8/2001 | Mittersinker et al. | |
| 6,443,615 | B1 * | 9/2002 | Chan | 368/316 |
| 6,464,419 | B1 | 10/2002 | Chan | |
| 6,804,170 | B1 * | 10/2004 | Chan | 368/88 |
| D498,259 | S | 11/2004 | Kung | |
| 2001/0045369 | A1 | 11/2001 | Pearlman et al. | |
| 2003/0010664 | A1 | 1/2003 | Bellin et al. | |
| 2003/0068186 | A1 | 4/2003 | Sorensen | |
| 2003/0152412 | A1 | 8/2003 | Rosso | |
| 2004/0109719 | A1 | 6/2004 | Rosso | |
| 2004/0221866 | A1 | 11/2004 | Greenfiled | |

* cited by examiner

*Primary Examiner*—Vit Miska
*Assistant Examiner*—Thanh S. Phan
(74) *Attorney, Agent, or Firm*—Daniel P. Burke & Associates, PLLC

(57) ABSTRACT

Devices comprising a multi-piece housing which move from a first configuration wherein an item is at least partially disposed within a housing to a second configuration wherein more of the item is disposed outside of the housing. Upon the selective actuation of a release, at least two housing portions initially move away from each other while the item moves from the first configuration toward the second configuration, the housing portions then move back toward each other, all in a damped motion. In the second configuration, at least a portion of the item is further away from the hinge-type connection than in the first configuration.

33 Claims, 10 Drawing Sheets

DEVICE WITH HOUSING AND DAMPED, MOTION TO EXTENDED POSITION

RELATED APPLICATION DATA

This application is a continuation-in-part of U.S. design application Ser. No. 29/227,397, filed Apr. 11, 2005.

BACKGROUND

Various devices have been known wherein it is desirable for functional and/or aesthetic reasons to provide a housing for a device. For example, it is not uncommon for a travel alarm to be provided in a housing. Traditionally, such housings are provided to protect the display and the control buttons during traveling.

Other devices have been disclosed wherein manual manipulation and/or activation of a release moves a portion of a device to a position where it is less covered by other structure. There is a desire for devices with novel movement, such as novelty items or promotional items. It would be particularly desirable to have a plurality of types of movement in a single device.

SUMMARY OF THE INVENTION

The various aspects of the present invention are directed to devices comprising a multi-piece housing. The devices of the present invention automatically move from a first configuration wherein an item is at least partially disposed within a housing to a second configuration wherein more of the item is disposed outside of the housing. The housing comprises at least two portions with a hinge-type connection. Upon the selective actuation of a release, at least sections of two housing portions initially move away from each other while the item moves from the first configuration toward the second configuration, the housing portions then move back toward each other, all in a damped motion. In the second configuration, at least a portion of the item is further away from the hinge-type connection than in the first configuration.

The disclosed embodiments utilize at least one driving mechanism comprising a spring for urging a connector which is connected to a housing portion and the item being housed. Upon activation of a release, the driving mechanism moves the connector. The disclosed driving mechanism also comprises closely spaced surfaces and damping grease for dampening the spring biased movement of the connector.

DETAILED DESCRIPTION

The present invention is directed to devices, for example, portable electronic devices, comprising at least one item disposed within a multi-part housing. The device is provided with a drive mechanism which, upon the activation of a release, causes portions of the housing which are hingedly connected to each other to initially move away from each other while the item is moved from a first position at least partially within the housing toward a position more outside the housing. The housing portions are initially moved away from each other and then are caused to move back toward each other as the item is extended more outwardly of the housing. In the illustrated embodiment, as the item is extended it is moved further away from the hinge connection of the housing portions.

Figure 1:
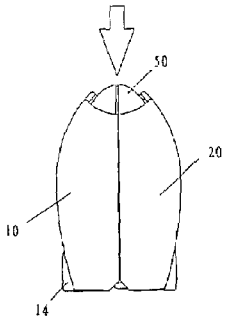
FIGS. 1 and 2 are side and perspective views, respectively, of one embodiment of the present invention in a closed configuration.
Figure 3:
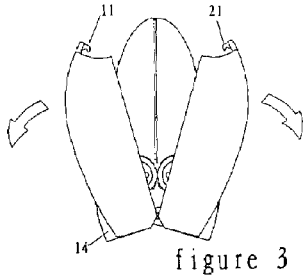
FIGS. 3 and 4 are side and perspective views, respectively, of the embodiment shown in FIG. 1 in a partially opened position.
Figure 5:
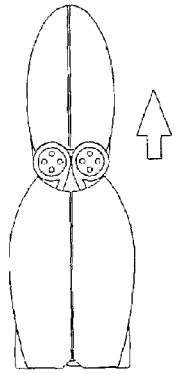
FIGS. 5 and 6 are side and perspective views, respectively, of the embodiment of FIG. 1 in an open configuration.
Figure 2:
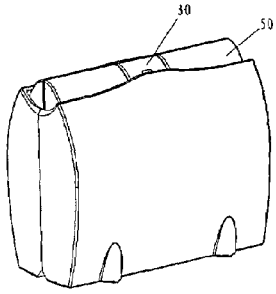
Figure 4:
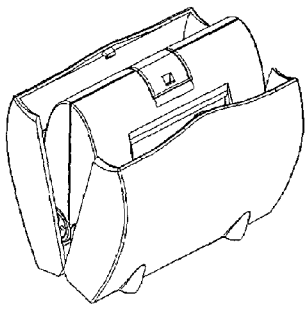
Figure 6:
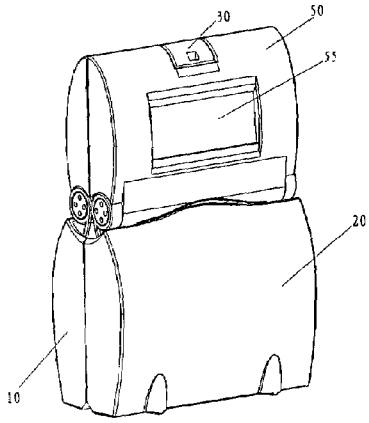

FIGS. 1 through 11 illustrate one embodiment of the present invention in the form of a device comprising an electronic alarm clock. The device is in a closed or storage position in FIGS. 1 and 2. This view illustrates first housing portion 10, second housing portion 20, clock 50 and release button 30. When release button 30 is depressed in the direction of arrow A (shown in FIG. 1), latches 11 and 21 of housing portions 10, 20, respectively, are released and movement begins. Upon the release of the latches, the drive mechanisms spreads the illustrated housing portions 10, 20 and extends the clock upwardly above the housing portions as shown in FIGS. 3 and 4. As upward movement of the clock continues, the housing portions are moved back substantially together and the clock display 55 is viewable as shown in FIGS. 5 and 6.

Figure 7:
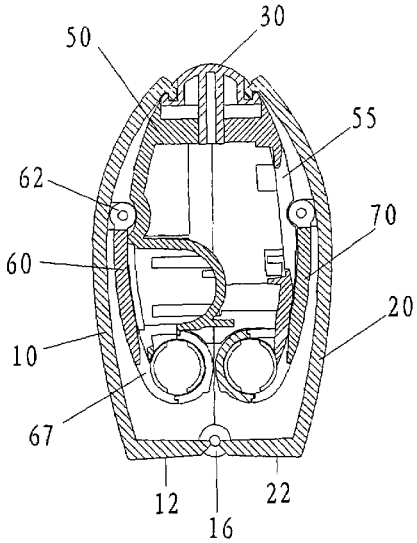
FIG. 7 is a cross-sectional view of the device in FIG. 1 in a closed position.

The actual operation of this illustrated embodiment of the present invention can more readily be appreciated from FIGS. 7–10. With reference to FIG. 7, the illustrated folding alarm clock comprises a first housing portion 10 and a second housing portion 20. In this particular embodiment, the display 55 of the clock 50 is intended to be extended vertically upward while the housing portions 10, 20 serve as a base. With this in mind, housing portion 10 is provided with a substantially flat lower surface 12 and a plurality of stabilizers 14 which enhance stability during use and operation. Similarly, second housing portion 20 comprises a substantially flat bottom surface 22 and stabilizers 24. These illustrated housing portions are hingedly connected at their bases with hinge connectors 16 and 26. During operation, hinge connector 16, 26, work cooperatively with pivotal hinge pins 15 shown in FIG. 11 and permit housing portions 10 and 20 to open in a generally pivotal manner and then close during the operation of the device. The clock also comprises suitable controls, e.g. to set the time, set an alarm, and control brightness of the display. These controls are not particularly relevant to the present invention and, therefore, are not described in detail.

As shown in FIGS. 7–10, according to this embodiment of the present invention, the housing portions 10, 20 are connected to the clock 50 with connectors 60, 70. Connector 60 has an upper portion 62 and a lower portion 67. For purposes of this discussion, the words "upper" and "lower" refer to the connector 60 when the folding alarm device is in its initial closed or non-extended configuration. The upper end 62 of connector 60 comprises flanges 63 which are connected to any cooperate with corresponding flanges 13 on the interior surface of housing portion 10. These corresponding flanges are connected with hinge pins (not shown) in order to provide a simple hinge connection between the upper portion of connector 60 and the interior surface of connector 10. The lower portion 67 of connector 60 comprises a pair of generally cylindrical flanges 68 for receiving at least a portion of a drive mechanism and for connecting the lower portion 67 of connector 60 to the lower portion 51 of the clock 50.

Figure 11:
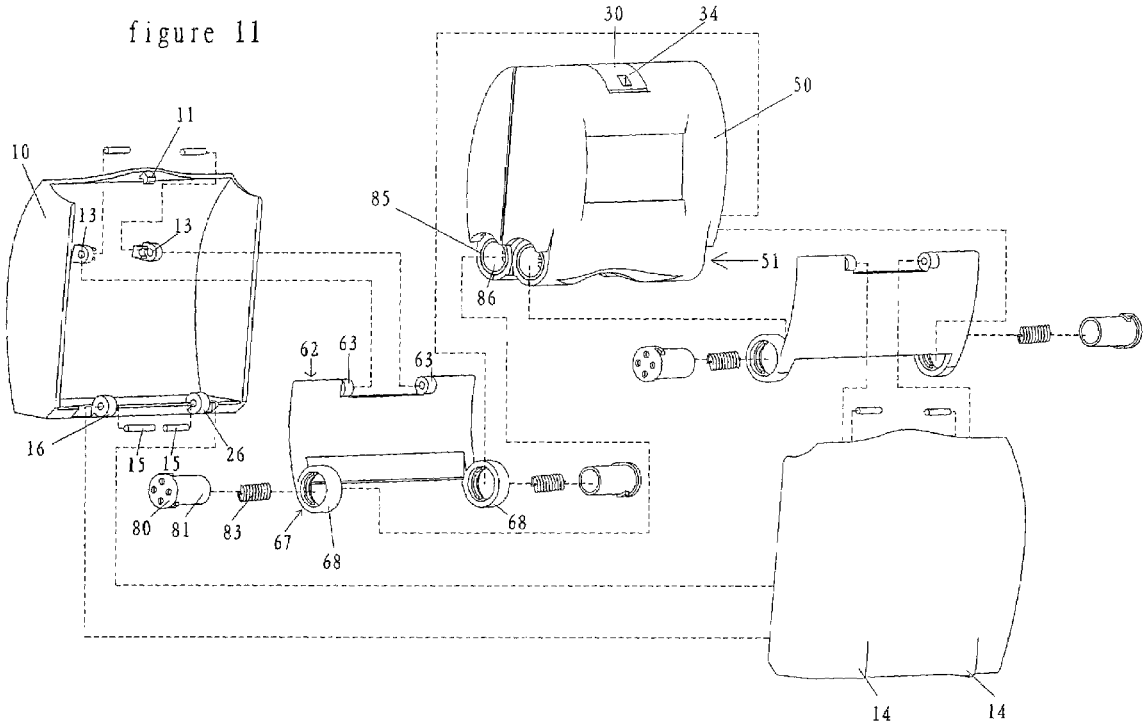
FIG. 11 is an exploded view of the device shown in FIG. 1.
Figure 12:
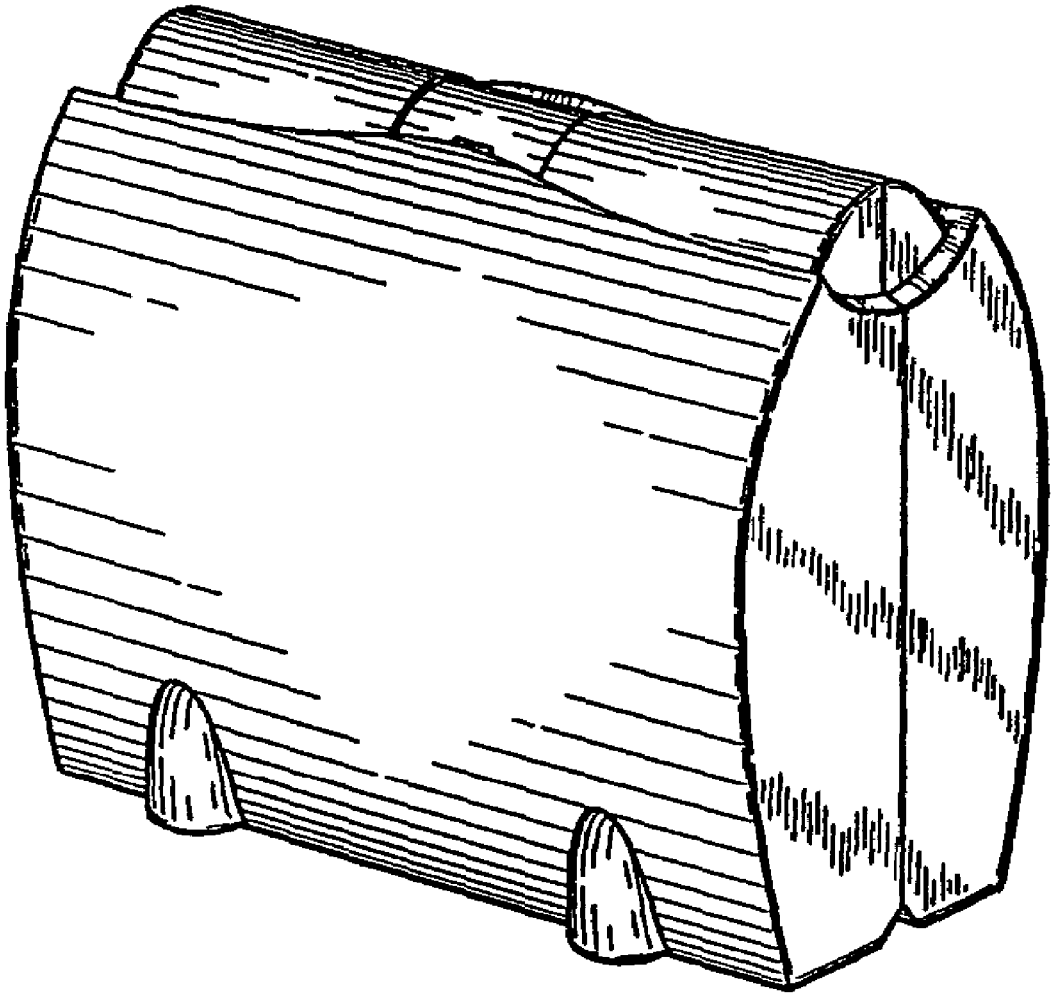
FIG. 12 is a perspective view of the device in the closed position.
Figure 13:
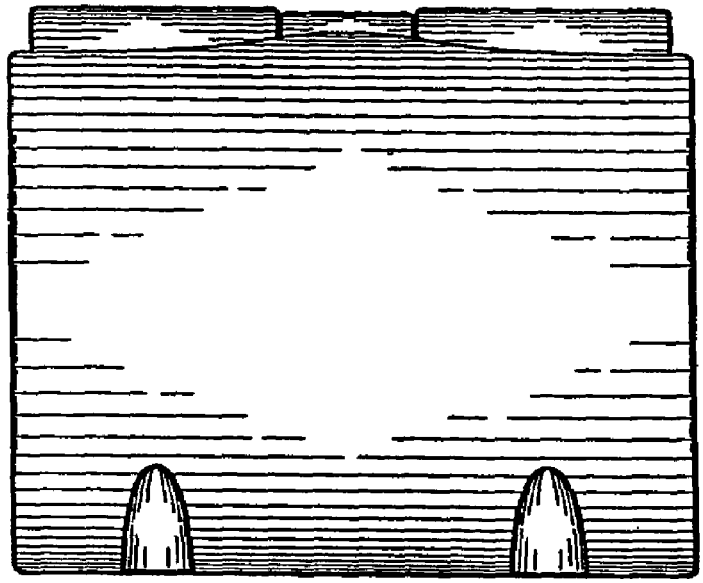
FIG. 13 is a front elevational view of the device in the closed position.
Figure 14:
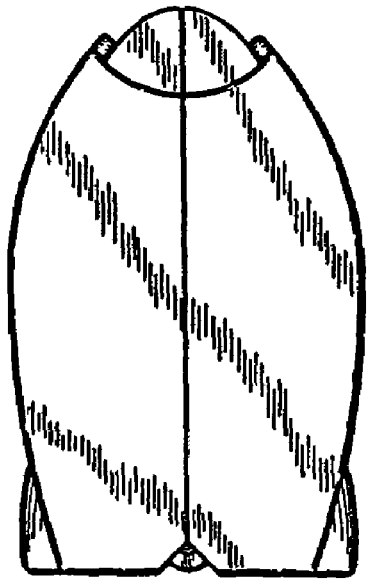
FIG. 14 is a side elevational view of the device in the closed position.
Figure 15:
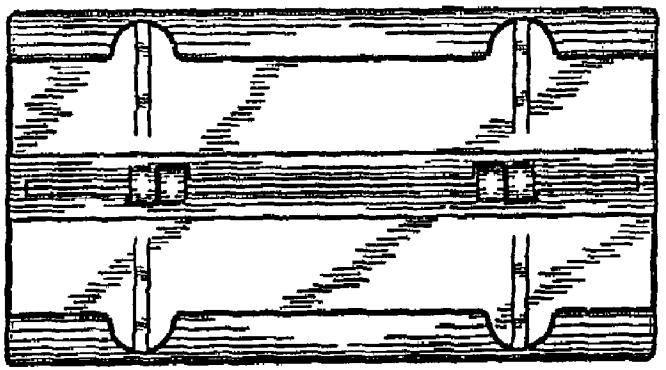
FIG. 15 is a bottom plan view.
Figure 16:
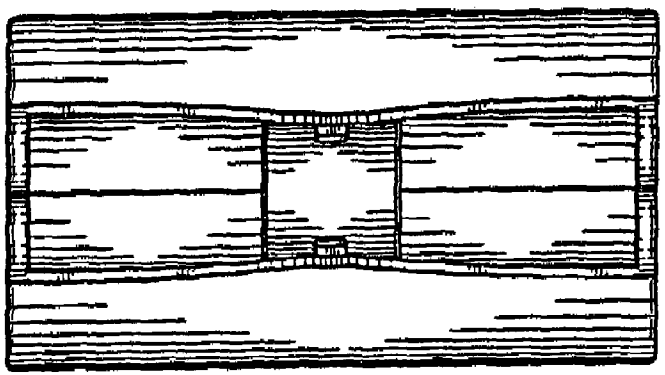
FIG. 16 is a top plan view.
Figure 17:
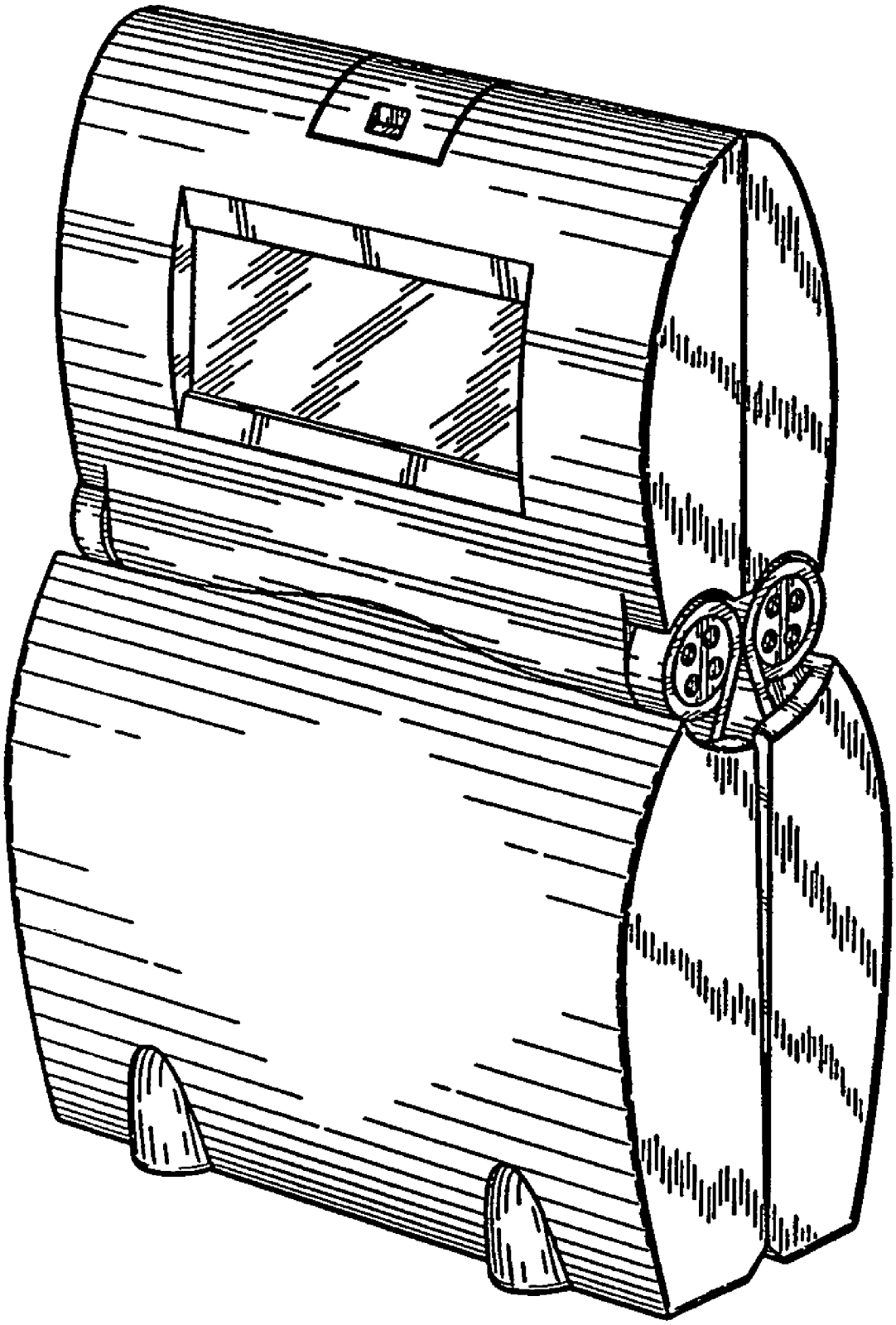
FIG. 17 is a perspective view of the device fully opened.
Figure 18:
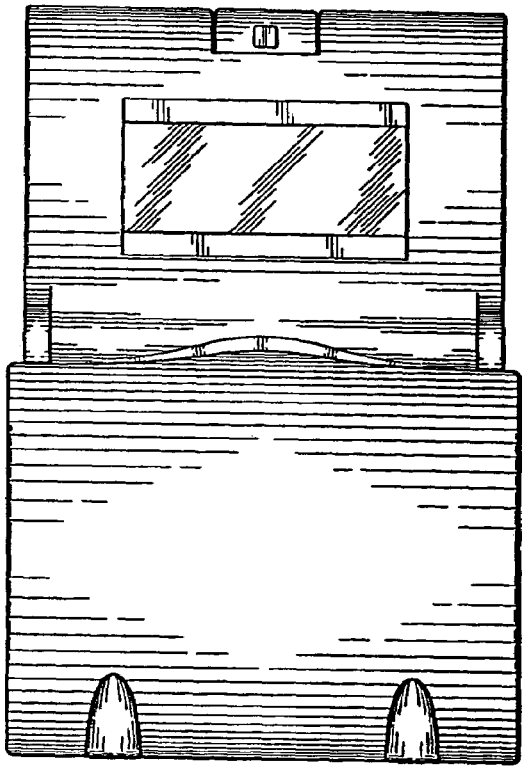
FIG. 18 is a front elevational view of the device fully opened.
Figure 19:
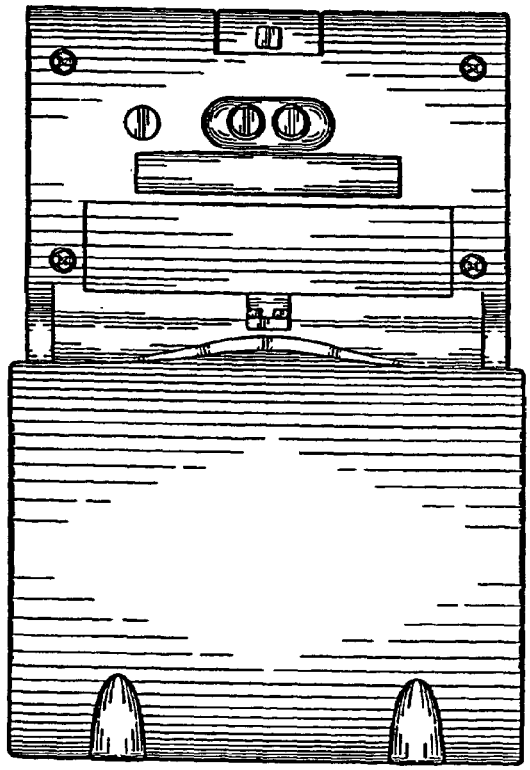
FIG. 19 is a rear elevational view of the device fully opened.
Figure 20:
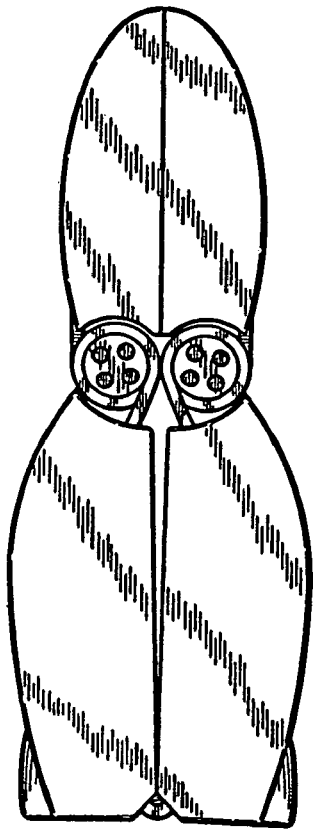
FIG. 20 is a side elevational view of the device fully opened.
Figure 21:
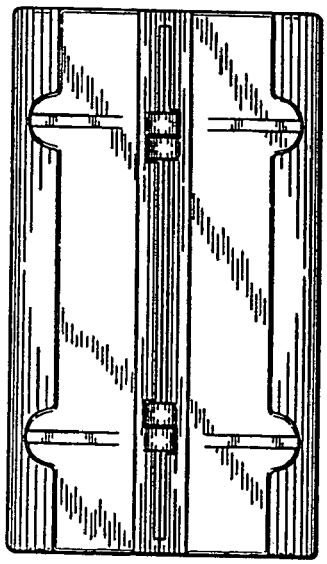
FIG. 21 is a bottom view of the device fully opened.
Figure 22:
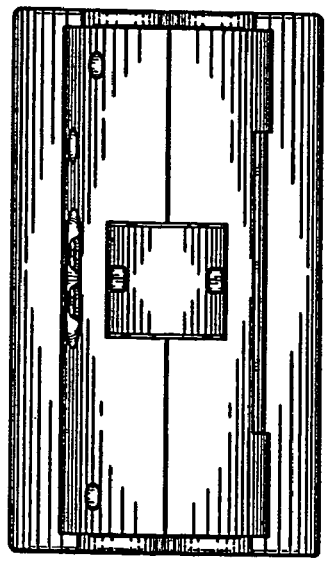
FIG. 22 a top plan view of the device fully opened.

With reference to FIG. 11, the drive mechanism of this embodiment of the present invention comprises a coil spring 83 which is advantageously pre-wound to provide a desired torsional force. The coil spring is positioned internally between a pair of cooperating, concentrically arranged barrel-shaped members, namely inner barrel 80 and outer barrel 85. The illustrated coil spring 83 advantageously comprises a cross wire, extending radially at each end thereof. Each of these cross wires of torsional coil spring 83 engage a slot in the interior ends of the illustrated barrel members when the barrel members are concentrically arranged during assembly. In this manner, each end of the spring will not move relative to the respective barrel member to which it is attached. A damping grease such as a highly viscous oil or grease is disposed between the outer surface of the inner barrel 80 and the inner surface 86 of the outer barrel 85. According to this illustrated embodiment, the outer barrel-shaped member 85 is fixed relative to the clock while the inner barrel member 81 is fixed relative to the flanges 68 on the lower portion 67 of connector 60. The two barrel members are relatively rotatable and will rotate relative to each other under the urging of coil spring 83. The arrangement of damping grease between the outer surface 81 of inner barrel 80 and the inner surface 86 of outer barrel 85 will dampen the speed of the relative rotational movement of the barrels and, therefore, result in a relatively slower rotational motion than would be provided in the absence of this damping arrangement. This illustrated embodiment comprises four driving mechanisms with two driving mechanisms connected to each connector. It is also within the scope of the present invention to use fewer or a greater number of driving mechanisms and/or a different number of connectors. In this embodiment, two driving mechanisms are connected to each of connector 60 and 70 which connect the clock 50 to the two housing portions 10, 20. Other forms of driving mechanisms are also feasible within the scope of the present invention provided that they provide the desired driving force and a damped motion. For example, other types and positions of biasing members, such as other types of springs, can be utilized. It is also within the scope of the present invention to use other arrangements to dampen the movement of the item relative to the housing. It should be appreciated, however, that the illustrated embodiment is preferred for its simplicity and reasonable cost.

Figure 8:
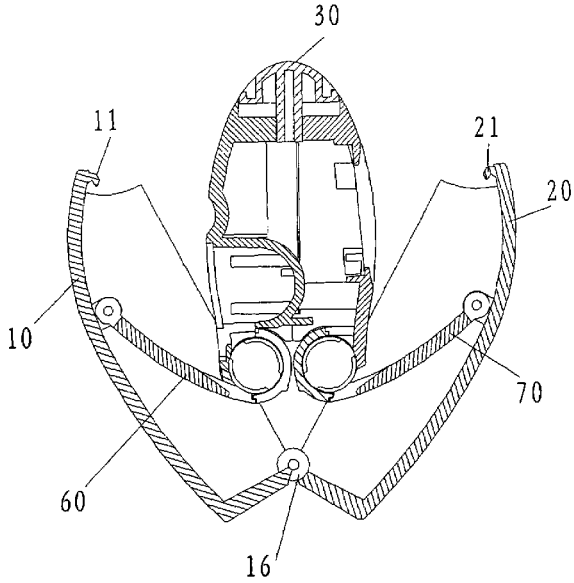
FIG. 8 is a cross-sectional view of the device shown in FIG. 1 having moved partially toward the open configuration.

The operation of this embodiment of the present invention may best be understood from FIGS. 7–10. In the initial unextended configuration shown in FIG. 7, the release button 30, which comprises a pair of opposing recesses 32 and 34 engages corresponding latches 11 and 21 on the upper portions of housing portions 10 and 20, respectively. In this configuration, the release button 30 is maintaining the housing portions 10 and 20 in the closed position against the urging force applied by the springs in the driving mechanisms which are urging the connectors 60 and 70 away from the display housing 50. When the release button 30 is depressed, the housing members 10 and 20 are urged outwardly under the damped, driving force of the driving mechanisms. As shown in FIG. 8, upper portion 62 of connector 60 rotates in a counter-clockwise direction relative to the lower portion 68 of connector 60 causing housing portion 10 to open to the left while upper portion 72 of connector 70 is rotated in a clock-wise direction relative to lower portion 77 of the connector 70. In this embodiment, the rotation of the connectors relative to the drive mechanisms causes the clock to move upwardly relative to the housing portions.

Figure 9:
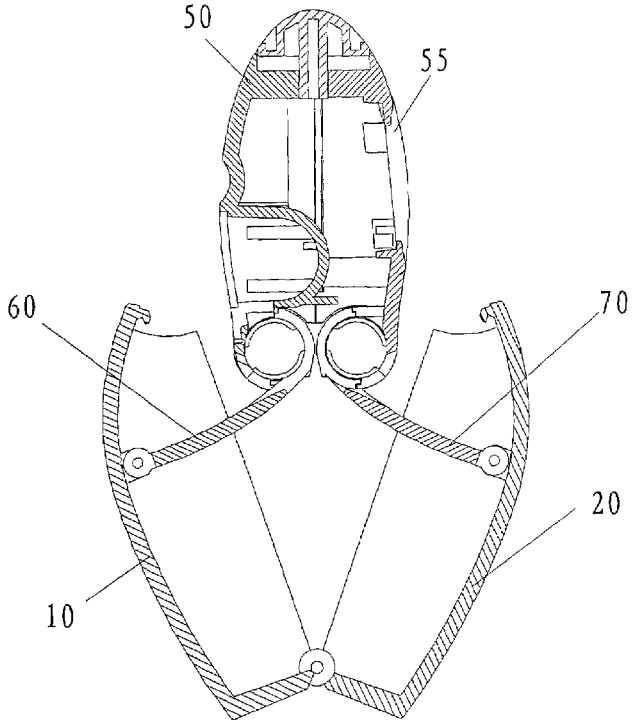
FIG. 9 is a cross-sectional view of the device shown in FIG. 1 having moved further toward the open configuration.
Figure 10:
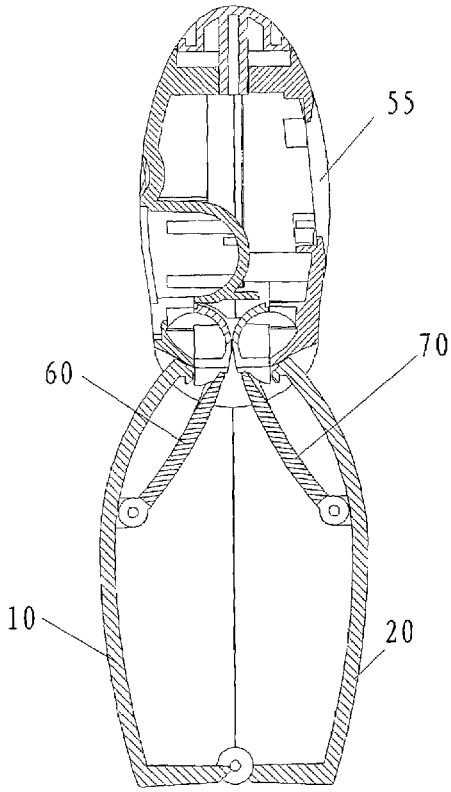
FIG. 10 is a cross-sectional view of the device shown in FIG. 1 in the fully extended position.

As shown in FIG. 9, after the connectors have passed a position of being generally perpendicular to the vertical axis, the continued motion of the connectors causes the housing portions to be drawn closer together as the clock continues to be extended upwardly. FIG. 10 illustrates the fully extended position of this embodiment of the present invention wherein the housing portions are drawn back close to each other and the clock is substantially extended beyond the housing members. The clock display 55 is readily viewable in this extended position.

From the present description, those skilled in the art will appreciate that the driving mechanisms can, not only take a different form, but can also be positioned in different places to affect the desired motion. For example, the driving mechanisms could be positioned at the "upper" end of the connectors while affecting the same motion.

The advantages of the present invention have been described relative to a clock, the advantages of the present invention can be used with an alarm clock, radio, cell phone, PDA, USB memory stick, calculator, penholder, photo frame, money holder, fan, lint brush, multi-tool (Swiss army knife), screwdriver set, reading lamp/flashlight, camera, and key holder.

While the illustrated embodiments, of the present invention utilizes a two-piece housing which also serves as a base from which an internal item is raised vertically in a damped motion, other embodiments of the present invention include different numbers of housing pieces and provide relative motion between an item and the housing in a direction other than vertical, such as horizontal and combinations of horizontal and vertical motions.

FIGS. 12–22 are external views of the device as shown.

While the present invention has been illustrated with a clock, other embodiments of the present invention include other items, including, but not limited to radios, cell phones, PDAs, USB memory sticks, calculators, penholders, photo frames, money holders, fans, lint brushes, multi-tools (e.g. Swiss army knife), screwdriver sets, reading lamps/flashlights, cameras, or key holders. According to certain embodiments, either a portion of the housing or an item can have a gripping portion which is designed to be held while other portions more relative to the gripped portion during opening.

What is claimed is:

1. An electronic device comprising a multi-piece housing and a display movably connected to said housing, said display movable between at least two configurations relative to said housing, including a first configuration wherein said display is disposed at least partially within said housing and a second configuration wherein said display is disposed substantially outside said housing;

said housing comprising at least a first housing portion, a second housing portion and means for hingedly connecting said first housing portion to said second housing portion;

means for moving sections of said first and second housing portions away from each other and then toward each other in a damped motion while moving said display from said first position toward said second position and further away from said connecting means.

2. An electronic device according to claim 1 wherein, in said first configuration, said display is substantially enclosed within said housing.

3. An electronic device according to claim 1 wherein, in said first configuration, said display is entirely enclosed within said housing.

4. An electronic device according to claim 1 wherein said moving means comprises:

at least one driving mechanism, and means for movably connecting said housing portions with said display comprising:

a first connector having a first end portion and a second end portion, said first end portion pivotally connected to one of said display and said first housing portion and said second end portion connected to said driving mechanism which is connected to the other of said display and said first housing portion; and a second connector pivotally connected to said display and pivotally connected to said second housing portion.

5. An electronic device according to claim 4 wherein said driving mechanism comprises at least one means for urging a portion of said first connector away from said display and means for damping the movement of said first connector.

6. An electronic device according to claim 5 wherein said urging means comprises a spring.

7. An electronic device according to claim 6 wherein said spring is a coil spring.

8. An electronic device according to claim 5 wherein said damping means comprises two relatively movable, spaced surfaces with a viscous grease between said surfaces.

9. An electronic device according to claim 5 wherein said damping means comprises two, relatively movable, substantially cylindrical surfaces with a viscous grease between said surfaces.

10. An electronic device according to claim 1 comprising a second driving mechanism connected to said second connector.

11. An electronic device according to claim 1 comprising at least two driving mechanisms connected to at least one of said connectors.

12. An electronic device according to claim 1 comprising at least two driving mechanisms connected to each of said connectors.

13. An electronic device according to claim 1 wherein said electronic device comprises a clock.

14. An electronic device according to claim 10 wherein said electronic device comprises an alarm clock.

15. An electronic device according to claim 1 further comprising means for releasably engaging at least one portion of said housing for releasably securing said housing in said first configuration.

16. An electronic device according to claim 1 wherein said housing portions form a stand for said device.

17. An electronic device according to claim 1 wherein said display is moved upwardly relative to said housing portions.

18. A device comprising a multi-piece housing and an item movably connected to said housing, said device movable between at least two configurations including a first configuration wherein said item is disposed at least partially within said housing and a second configuration wherein less of said item is disposed within said housing than when said device is in said first configuration;

said housing comprising at least a first housing portion and a second housing portion hingedly connected to said first housing portion;

means for moving sections of at least two portions of said housing away from each other and then toward each other in a damped motion while moving said item from said first position toward said second position and further away from at least sections of said first and second housing portions which are hingedly connected.

19. A device according to claim 18 wherein, in said first configuration, said item is substantially enclosed within said housing.

20. A device according to claim 18 wherein, in said first configuration, said item is entirely enclosed within said housing.

21. A device according to claim 18 wherein said moving means comprises:

at least one driving mechanism, and at least one connector for each of said movable housing portions for movably connecting said housing portions with said item including:

a first connector having a first end portion and a second end portion, said first end portion pivotally connected to one of said item and said first housing portion and said second end portion connected to said driving mechanism which is connected to the other of said item and said first housing portion; and a second connector pivotally connected to said item and pivotally connected to said second housing portion.

22. A device according to claim 20 wherein said driving mechanism comprises at least one means for urging a portion of said first connector away from said item and means for damping the movement of said first connector.

23. A device according to claim 20 wherein said urging means comprises a spring.

24. A device according to claim 23 wherein said spring is a coil spring.

25. A device according to claim 22 wherein said damping means comprises two relatively movable, spaced surfaces with a viscous grease between said surfaces.

26. A device according to claim 22 wherein said damping means comprises two, relatively movable, substantially cylindrical surfaces with a viscous grease between said surfaces.

27. A device according to claim 18 comprising a second driving mechanism connected to said second connector.

28. A device according to claim 18 comprising at least two driving mechanisms connected to at least one of said connectors.

29. A device according to claim 18 comprising at least two driving mechanisms connected to each of said connectors.

30. A device according to claim 18 wherein said device comprises a clock.

31. A device according to claim 18 wherein said housing portions form a stand for said device.

32. A device according to claim 18 further comprising means for releasably engaging at least one portion of said housing for releasably securing said housing in said first configuration.

33. A device according to claim 18 wherein said item is moved upwardly relative to said housing portions.

* * * * *